US007139499B2

(12) United States Patent
Sasamoto et al.

(10) Patent No.: US 7,139,499 B2
(45) Date of Patent: Nov. 21, 2006

(54) INDUCTION HEATING TYPE OF FIXING DEVICE AND IMAGE FORMING APPARATUS EQUIPPED THEREWITH

(75) Inventors: Yoshihito Sasamoto, Hachioji (JP); Kiyoaki Kawamoto, Kunitachi (JP); Atsushi Takahashi, Akishima (JP); Hiroshi Matsumoto, Hachioji (JP); Tetsuko Kurosu, Hino (JP); Hideaki Tanaka, Fussa (JP); Naohiko Hanyu, Hino (JP); Akifumi Isobe, Hidaka (JP)

(73) Assignee: Konica Minolta Business Technologies, Inc. (JP)

( * ) Notice: Subject to any disclaimer, the term of this patent is extended or adjusted under 35 U.S.C. 154(b) by 199 days.

(21) Appl. No.: 10/924,648

(22) Filed: Aug. 24, 2004

(65) Prior Publication Data

US 2005/0117923 A1 Jun. 2, 2005

(30) Foreign Application Priority Data

Nov. 27, 2003 (JP) ..... 2003-397240
Dec. 24, 2003 (JP) ..... 2003-426510
Jul. 8, 2004 (JP) ..... 2004-201772

(51) Int. Cl.
*G03G 15/20* (2006.01)

(52) U.S. Cl. ..... 399/69; 219/619; 399/45; 399/334

(58) Field of Classification Search ..... 399/69, 399/45, 33, 44, 320, 328, 334; 219/216, 219/619, 470; 347/156
See application file for complete search history.

(56) References Cited

U.S. PATENT DOCUMENTS 5,204,723 A * 4/1993 Hanada et al. ..... 219/216 X
6,301,454 B1 * 10/2001 Nishida et al. ..... 399/69
6,763,206 B1 * 7/2004 Kinouchi et al. ..... 399/334 X
6,850,728 B1 2/2005 Yokozeki et al. ..... 399/328
2003/0198481 A1 * 10/2003 Kikuchi et al. ..... 399/69
2005/0013622 A1 * 1/2005 Omoto et al. ..... 399/69
2005/0205558 A1 * 9/2005 Kinouchi et al. ..... 219/619
2005/0207773 A1 * 9/2005 Nakayama ..... 399/69

FOREIGN PATENT DOCUMENTS

| | | |
|---|---|---|
| JP | 2000-206813 | 7/2000 |
| JP | 2002-023557 | 1/2002 |
| JP | 2002-124369 | 4/2002 |
| JP | 2003-308956 | 10/2003 |
| JP | 2003-317923 | 11/2003 |
| JP | 2003-317924 | 11/2003 |
| JP | 2003-345170 | 12/2003 |

OTHER PUBLICATIONS

English Abstract of JP2000-206813.
English Abstract of JP2002-023557.
English Abstract of JP2002-124369.

* cited by examiner

*Primary Examiner*—Sophia S. Chen
(74) *Attorney, Agent, or Firm*—Cantor Colburn LLP

(57) ABSTRACT

An induction heating type of fixing device to fix a recording material having a toner image thereon, having a heating member, an induction coil divided into a plurality of parts, a temperature detector for detecting a temperature of the heating member, a signal generator for generating a switching signal that periodically controls permission and prohibition of energization of each of the divided induction coils, and a controller for controlling supply of a driving current to each of the divided induction coils to heat the heating member. The controller controls the energization by periodically switching the driving current to each of the divided induction coils on the basis of an energization signal that determines the permission and the inhibition of the driving currents according to a signal of temperature detected by the temperature detector, and the switching signal.

12 Claims, 9 Drawing Sheets

INDUCTION HEATING TYPE OF FIXING DEVICE AND IMAGE FORMING APPARATUS EQUIPPED THEREWITH

BACKGROUND OF THE INVENTION

This invention relates to an induction heating type of fixing device and an image forming apparatus equipped therewith such as copy machine, printer and facsimile equipment. More particularly, this invention relates to energization control of an induction heating type of fixing device.

The image forming apparatus is equipped with a fixing device that thermally fixes toner images on a recording material. An induction heating type of fixing device is equipped with an electroconductive heating roller including an induction coil as a heat source and a pressing roller that is pressed against the heating roller and forms a nip section.

The induction coil is as long as the maximum width of the recording material to heat the whole heating roller (maximum width of the recording material). This configuration has caused various problems such as uneven surface temperature of the heating roller along the roller axis and unwanted temperature rises at roller surfaces where a recording material of a smaller size (than the maximum width of the recording material) does not pass by. To solve such problems, some methods have been disclosed. One of such methods is dividing one induction coil into some parts and controlling the quantities of currents to respective induction coil parts according to the quantity of current to a preset induction coil part. Another method is controlling energization of respective induction coil parts independently.

For example, Patent Document 1 discloses a fixing device that controls currents to drive second and later excitation coils according to the current to drive the first excitation coil in order to keep the surface temperature of the fixing roller constant along its axis.

Patent Document 2 discloses an induction heating type of fixing device that is equipped with first and second temperature measuring means for detecting surface temperatures of a roller to be heated by first and second induction coils and controls driving currents for the induction coils independently to prevent excessive temperature rise at roller surfaces where a recording material of a smaller size does not pass by.

Patent Document 3 discloses an induction heating type of fixing device that synchronizes switching operations to turn on and off inputs to a plurality of induction coils, generates on-off signals by frequency modulation, and assigns a delay time for the turn-on signal of each induction coil.

Patent Documents 1, 2 and 3 mentioned above denote Japanese Non-examined Patent Publications 2000-206813, 2002-23557, and 2002-124369, respectively.

However, in the above prior art that energize a plurality of divided induction coils independently, it may sometimes happen that the induction coils may be energized simultaneously when operation modes or paper sizes are changed in the image forming apparatus.

When a high-frequency driving current flows through an induction coil that is made of a copper wire, the coil may generate a small vibration under the influence of a magnetic field. When the induction coils and the heating roller have different characteristics such as inductances and capacitances, the driving currents supplied from a power supply may have different frequencies. Therefore, if the adjoining induction coils are energized simultaneously, driving currents of different frequencies flow through the induction coils and cause the coils to generate small vibrations. These small vibrations turn into a big vibration by resonance. Further, this vibration resonates the heating roller and as the result, the induction coils generate noises such as resonant noises.

When the induction coils are not energized simultaneously, the temperature of the heating member may drop because of a loss time during which the heating member is not heated by the induction coils. This temperature drop causes a fixing trouble and a reduction in the heating rate of the heating member. Consequently, this prolongs the warm-up time (WUT: a time period required to heat up the heating member until it becomes ready to fix). Therefore, it is requested to control energization of induction coils without a loss time when heating the heating member.

Meanwhile, the image forming apparatus-has a maximum current rating (for ecxample, 15 A) and a maximum current available to the fixing device is limited by the operation mode (Image Formation mode, Warm-up mode, or Standby mode) of the image forming apparatus.

Judging from the above, we are requested to do the following when controlling energization of the fixing device: to avoid simultaneous energization of induction coils and to control energization more finely according to the operation mode of non-fixing devices in the image forming apparatus in consideration of the current supply balance of the induction coils.

SUMMARY OF THE INVENTION

An object of this invention is to provide energization control that can prevent the induction heating coils from generating vibrations and noises, assure a maximum current for the fixing device in the limited driving current range available to the fixing device in the image forming apparatus, heat the heating member efficiently, and minimize the temperature change of the heating member.

The above object can be accomplished by one of the Structures (1) to (12) below.

(1) An induction heating type of fixing device to fix a recording material having a toner image on it, comprising a heating member, an induction coil divided into a plurality of parts, a temperature detecting means for detecting a temperature of the heating member, a signal generating means for generating a switching signal that periodically controls permission and prohibition of energization of each of the divided induction coils, and a control means for controlling supply of a driving current to each of the divided induction coils to heat the heating member, wherein the control means controls the energization by periodically switching the driving current to each of the divided induction coils on the basis of an energization signal that determines the permission and the inhibition of the driving currents according to a signal of temperature detected by the temperature detecting means, and the switching signal.

(2) The induction heating type of fixing device of Structure (1), wherein the switching signal is applied to the adjoining first induction coil and second induction coils among the divided induction coils to inhibit energization of one of the induction coils when energization of the other induction coil is permitted or to permit energization of one of the induction coils when energization of the other induction coil is inhibited.

(3) The induction heating type of fixing device of Structure (2), wherein a plurality of temperature detecting means are provided and one cycle time and duty cycle of the switching signal are determined according to a difference of temperatures detected by the temperature detecting means.

(4) The induction heating type of fixing device of Structure (2), wherein the switching signal is determined by at least one of the size and type of a recording material in use and the operation mode.

(5) The induction heating type of fixing device of Structure (2), wherein the control means stops applying driving currents to all of the induction coils when the energization signal permits energization of the driving current and the switching signal does not change for a preset time period or longer.

(6) The induction heating type of fixing device of Structure (2), wherein the switching signal is a PWM (Pulse Width Modulation) signal.

(7) An image forming apparatus comprising an image carrier for carrying a toner image, a transfer means for transferring a toner image from the image carrier onto a recording material, and an induction heating type of fixing device for thermally fixing the recording material having a toner image on it, wherein the induction heating type of fixing device comprises a heating member, an induction coil divided into a plurality of parts, a temperature detecting means for detecting a temperature of the heating member, a signal generating means for generating a switching signal that periodically controls permission and prohibition of energization of each of the divided induction coils, and a control means for controlling supply of a driving current to each of the divided induction coils to heat the heating member, wherein the control means controls the energization by periodically switching the driving current to each of the divided induction coils on the basis of an energization signal that determines the permission and the inhibition of the driving currents according to a signal of temperature detected by the temperature detecting means, and the switching signal.

(8) The image forming apparatus of Structure (7), wherein the switching signal is applied to the adjoining first induction coil and second induction coils among the divided induction coils to inhibit energization of one of the induction coils when energization of the other induction coil is permitted or to permit energization of one of the induction coils when energization of the other induction coil is inhibited.

(9) The image forming apparatus of structure (8), wherein a plurality of temperature detecting means are provided and one cycle time and duty cycle of the switching signal are determined according to a difference of temperatures detected by the temperature detecting means.

(10) The image forming apparatus of Structure (8), wherein the switching signal is determined by at least one of the size and type of a recording material in use and the operation mode.

(11) The image forming apparatus of Structure (8), wherein the control means stops applying driving currents to all of the induction coils when the energization signal permits energization of the driving current and the switching signal does not change for a preset time period or longer.

(12) The image forming apparatus of Structure (8), wherein the switching signal is a PWM signal.

According to Structures (1) and (7), a control means is provided to perform energization control by periodically switching the driving current to each of the divided induction coils on the basis of an energization signal that determines the permission and the inhibition of the driving currents according to a signal of temperature detected by the temperature detecting means, and the switching signal. This can suppress simultaneous energization of adjoining induction coils, as well as generation of vibrations and noises of the induction coils, and assure a maximum current for the fixing device in the limited driving current range available to the fixing device in the image forming apparatus, and obtain a uniform temperature distribution on the heating roller.

According to Structures (2) and (8), the switching signal is applied to the adjoining first induction coil and second induction coils among the divided induction coils to inhibit energization of one of the induction coils when energization of the other induction coil is permitted or to permit energization of one of the induction coils when energization of the other induction coil is inhibited. This can control energization of each induction coil without simultaneous energization of the adjoining induction coils and consequently realize a uniform temperature distribution on the heating roller. Further this can offer a stable fixing ability without causing the recording material to get wrinkles even when the image forming apparatus changes the operation mode.

According to Structures (3) and (9), a plurality of temperature detecting means are provided and one cycle time and duty cycle of the switching signal are determined according to a difference of temperatures detected by the temperature detecting means. This enables setting of any cycle time of the switching signal and minimizes the influence by a drop of the driving current that happens when the driving current is switched between the adjoining induction coils. As the result, this can reduce a temperature ripple in the heat distribution on the heating roller and a temperature difference between the center portion and the ends portions of the roller. The driving current for each of adjoining induction coils can be made different by changing a duty cycle of the switching signal.

According to Structures (4) and (10), the switching signal is determined by at least one of the size and type of a recording material in use and the operation mode. This can make the temperature distribution even on the heating roller independently of the type of recording material in use and the operation mode of the image forming apparatus.

According to Structures (5) and (11), the driving means stops applying driving currents to all of the induction coils when the energization signal permits energization of the driving current and the switching signal does not change for a preset time period or longer.

This can stop energization of driving currents to the induction coils when the control means runs away or when a cable is grounded. As the result, this can improve the safety of energization control of the induction heating type of fixing device.

According to Structures (6) and (12), the switching signal is a PWM signal. This enables easy and fast signal switching and efficient heating of the heating roller without a time loss. This can also enables the use of a switching signal for detection of abnormality.

DETAILED DESCRIPTION OF THE PREFERRED EMBODIMENT

The embodiment of this invention will be detailed with reference to the accompanying drawings.

(Embodiment)

<Configuration of the Image Forming Apparatus>

The image forming apparatus of this invention has an image carrier for carrying a toner image, a transfer means for transferring a toner image from the image carrier to a recording material, and an induction heating type of fixing device for thermally fixing the recording material having a toner image on it. The image carrier can be a photosensitive material or intermediate transfer member.

Figure 1:
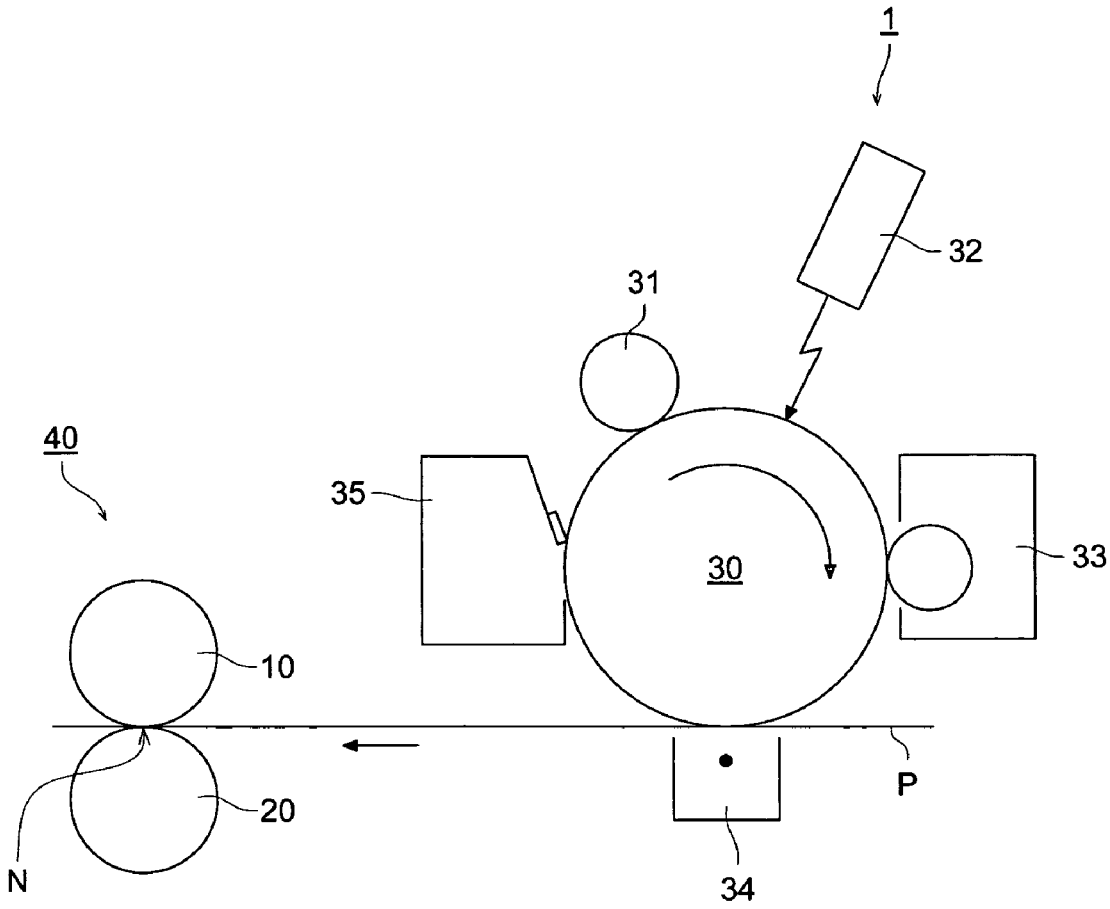
FIG. 1 is a schematic diagram of the image forming apparatus 1 which is an embodiment of this invention.

As shown in FIG. 1, the image forming apparatus is equipped with a photosensitive drum 30 as an image carrier and takes the steps of applying a preset potential to the surface of the photosensitive drum 30 by a charger 31, exposing an image to the surface of the photosensitive drum 30 by the exposing means 32 to form a latent image thereon, developing the latent image with a developing agent containing a toner and a carrier to make it visible, by a developer 33, transferring the visible toner image to a recording material P such as paper which is delivered to the photosensitive drum 30 by a transferring means 34, and removing the remained toner from the surface of the photosensitive drum 30 by the cleaner 35 to prepare for the next image formation.

The recording material P having the visible toner image is delivered from the photosensitive drum 30 to the induction heating type of fixing device 40 and thermally fixed by the fixing device 40. With this, the toner image is permanently fixed to the recording material P.

The induction heating type of fixing device of this invention is composed of a heating member for thermally fixing a toner image to a recording material, a pressing member for forming a nip section in pressure contact with the heating member, and an induction heating coil in the heating member. The heating member can be a heating roller or a heating roller. However, the heating roller is preferable as it is high in heat efficiency. The pressing member can be a pressing roller or a pad. However, the pressing roller is effective. The induction heating type of fixing device 40 of FIG. 1 is composed of a heating roller 10 as a heating member, a pressing roller 20 as a pressing member that forms a nip section N in pressure contact with the heating roller, and an induction heating coil in the heating roller 10 to heat the roller by induction. The toner image on the recording material P is fixed while passing through the nip section N that is formed by pressure contact of the heating roller 10 and the pressing roller 20.

Figure 2:
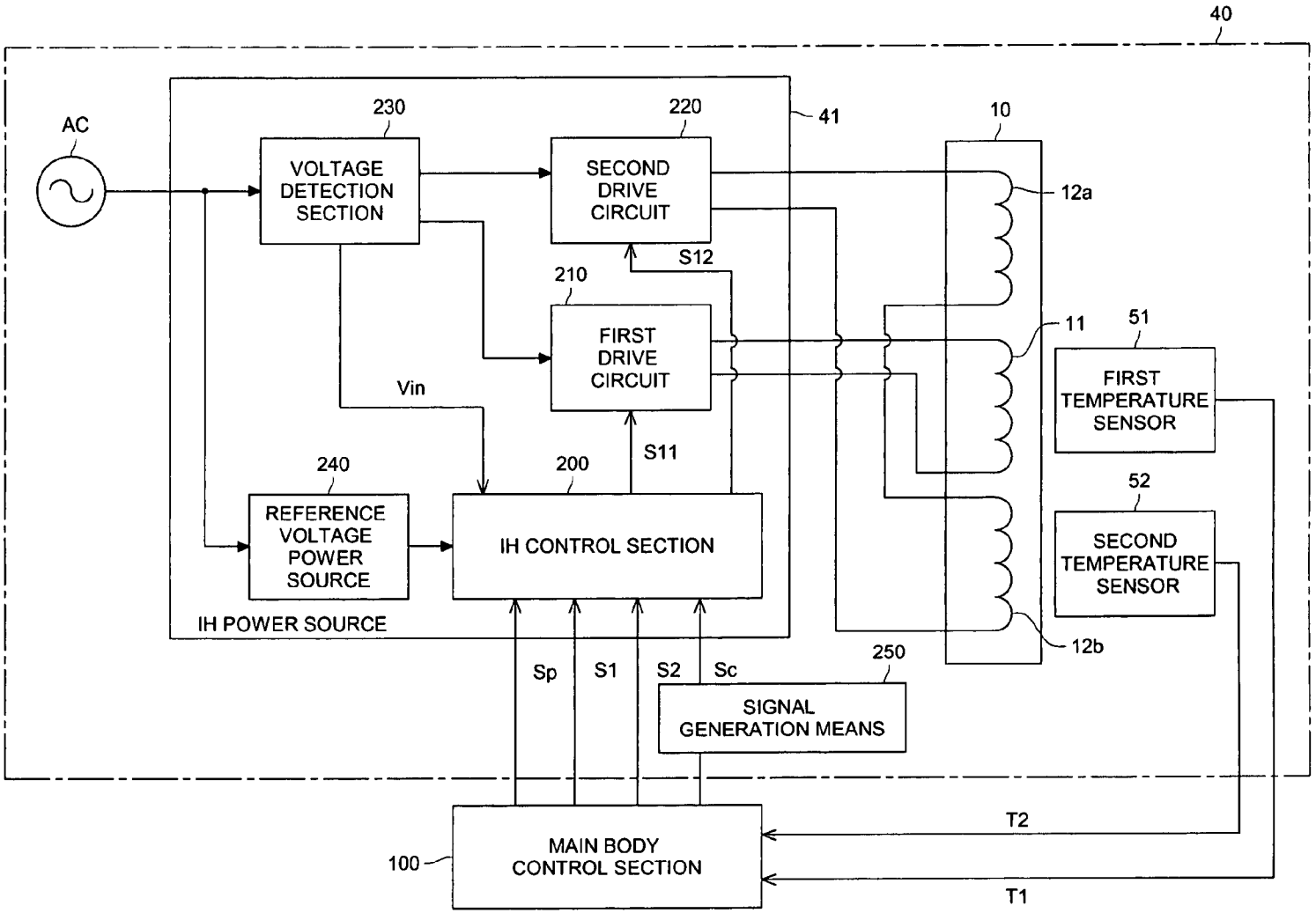
FIG. 2 is a functional block diagram of the control circuit in the induction heating type of fixing device 40.

FIG. 2 is a functional block diagram of the control circuit in the induction heating (IH) type of fixing device 40.

As shown in FIG. 2, the induction heating type of fixing device 40 is composed of a device system made up with a heating roller 10, a first induction coil 11 that heats the center of the heating roller 10, and second induction coils 12*a* and 12*b* that heat both ends of the heating roller 10, an a.c. power supply AC, an IH power supply block 41 as a means for driving a first induction coil 11 and second induction coils 12*a* and 12*b*, a first temperature sensor 51 as a means for detecting the temperature of center part of the heating roller 10 corresponding to the first induction coil 11, and a second temperature sensor 52 as a means for detecting the temperature of end portions of the heating roller 10 corresponding to the second induction coils 12*a* and 12*b*.

A main body control section 100 is provided to control energization of the adjoining first induction coil 11, and second induction coils 12*a* and 12*b*.

The main body control section 100 collectively controls operations of respective components of the image forming apparatus 1. The control section 100 receives a first detection temperature T1 from the first temperature sensor 51 and a second detection temperature T2 from the second temperature sensor 52, and outputs, to the IH control block 200, a first energization signal S1 that enables power supply to the first induction coil 11 and a second energization signal S2 that enables power supply to the second induction coils 12*a* and 12*b*. Further, the control section 100 controls the PWM signal generating means 250 to output a switching signal (PWM signal) that instructs to switch the first induction coil 11 and the second induction coils 12*a* and 12*b* for energization to the IH control block 200. Furthermore, the control section 100 calculates a current value setting signal Sp that determines the values of the currents to be supplied to the first induction coil 11 and the second induction coils 12*a* and 12*b*, and outputs the signal Sp to the IH control block 200. The temperatures on the heating roller 10 are controlled by this energization control of the first induction coil 11 and the second induction coils 12*a* and 12*b*.

The IH power source 41 is provided with an IH control section 200, a first drive circuit 210, a second drive circuit 220, a voltage detection section 230, and a reference voltage power source 240, and so on.

The IH control section 200 receives a first energization signal S1, a second energization signal S2, a current value setting signal Sp and a switching signal Sc from the main body control section 100, calculates a first drive signal S11 for the first induction coil 11, second drive signals S12 for the second induction coils 12*a* and 12*b*, and outputs them respectively to the first drive circuit 210 and the second drive circuit 220.

The IH control section 200 monitors the first energization signal S1, the second energization signal S2, and the switching signal Sc that come from the main body control section 100, and stops application of the driving currents to the first coil 11 and the second induction coils 12*a* and 12*b* by using the first and second drive signals S11 and S12 when at least one of the first and second energization signals S1 and S2 instructs to enable the drive current and when the switching signal Sc does not change for a preset time period or longer.

As explained above, the IH control section 200 monitors the first energization signal S1, the second energization signal S2, and the switching signal Sc that come from the main body control section 100. This can stop supplying the driving currents to the induction coils when the control section runs away or when a cable is grounded.

The first drive circuit 210 has a rectifying circuit for rectifying an a.c. power fed from the a.c. power supply AC to a d.c. current, a capacitor for always supplying a d.c.

current of a constant frequency to the first induction coil 11, a switching element to on/off a power to the first induction coil 11, and a gate driver circuit for driving the switching element. The first drive circuit 210 receives a first drive signal S11 from the IH control section 200, causes the gate driver circuit to operate the switching circuit, and thus supplies a driving current to the first induction coil 11.

The second drive circuit 220 has a rectifying circuit for rectifying an a.c. power fed from the a.c. power supply AC to a d.c. current, a capacitor for always supplying a d.c. current of a constant frequency to the second induction coils 12*a* and 12*b*, a switching element to turn on or off a power to the second induction coils 12*a* and 12*b*, and a gate driver circuit for driving the switching element. The second drive circuit 220 receives a second drive signal S12 from the IH control section 200, causes the gate driver circuit to operate the switching circuit, and thus supplies the driving currents to the second induction coils 12*a* and 12*b* that are provided both ends of the heating roller 10.

The switching element can be an insulated gate bipolar transistor (IGBT) or the like.

The voltage detection section 230 detects a voltage of power supplied from the a.c. power supply AC to the IH power source 41, and outputs the detected voltage Vin to the IH control section 200.

The reference voltage power section 240 branches power that was entered to the IH power source 41 from the a.c. power supply AC to the IH control section 200 as a power supply to drive the IH control section 200.

The first temperature sensor 51 is provided in contact with or close to the circumference of the heating roller 10 opposite the first induction coil 11. The sensor 51 detects the temperature on the center portion of the heating roller 10 and outputs the detected first temperature T1 to the main body control section 100.

The second temperature sensor 52 is provided in contact with or close to the circumference of the heating roller 10 opposite the second induction coil 12*a* or 12*b*. The sensor 52 detects the temperature on the end portion of the heating roller 10 and outputs the detected second temperature T2 to the main body control section 100.

As the second drive circuit 220 supplies identical driving currents to the second induction coils 12*a* and 12*b* that are provided in both end portions of the heating roller, it is assumed that the temperature distributions are identical on both end portions of the heating roller. Therefore, the second temperature sensor 52 can be provided opposite only one of the induction coils 12*a* or 12*b*.

The first and second temperature sensors 51 and 52 can be any temperature sensors such as thermistors, thermocouples, infrared sensors, and others as long as they can detect the surface or nearby temperature of the heating roller 10.

The control means of this invention is composed of the main body control section 100, the IH control section 200, the first drive circuit 210, and the second drive circuit 220.

Figure 3:
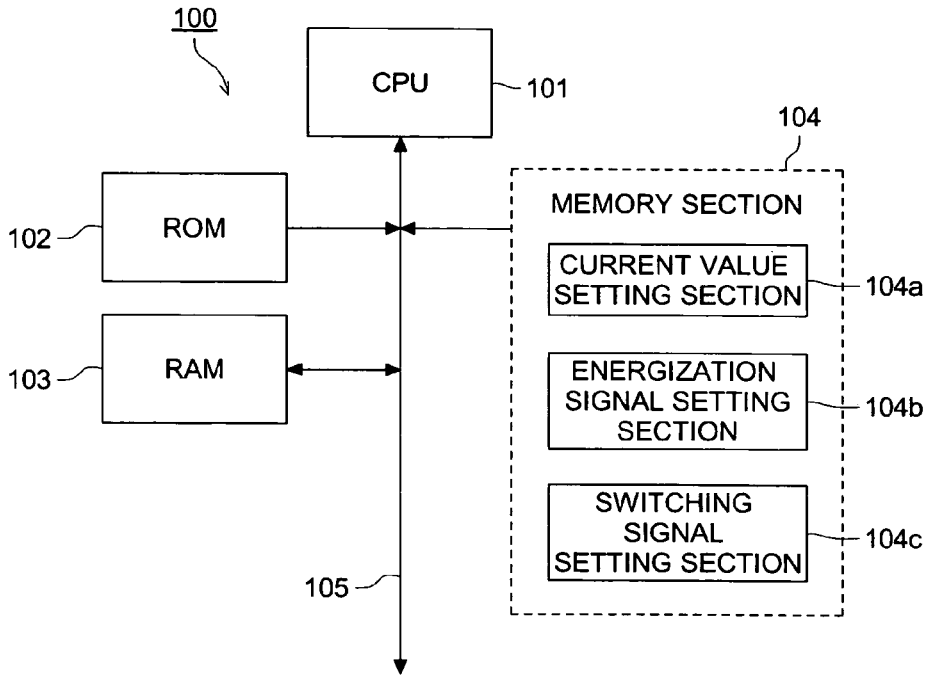
FIG. 3 is a functional block diagram of the main body control section 100.

FIG. 3 is a functional block diagram of the main body control section 100.

As shown in FIG. 3, the main body control section 100 is composed of a central processing unit (CPU) 101, read-only memory (ROM) 102, random access memory (RAM) 103, and a memory section 104. These components are interconnected with a bus 105 working as a transmitting means.

To realize this invention, the CPU 101 reads programs and data from respective sections (namely, the current value setting section 104*a*, the energization signal setting section 104*b*, and the switching signal setting section 104*c*) in the memory section 104, calculates the first energization signal S1, the second energization signal S2, the switching signal Sc and the current value setting signal Sp according to the size and type of a recording material P and an operation mode such as image formation, warm-up, or standby mode, and outputs the result to the IH control section 200.

Further, the CPU 101 receives a signal from an operation section that selects a size and type of a recording material P and a signal from a sensor that detects the size of paper in use, recognizes the type and size of the recording material P and recognizes the paper width (not shown in the figure).

Further, the CPU 101 reads a system program, processing programs, and data from the memory section 104, extract them on RAM 103, and collectively controls operations of components in the image forming apparatus 1 by the extracted programs. Furthermore, the CPU 101 performs timing control of the whole system, control to store and accumulate image data using RAM 103, image processing (variable magnification, filtration, and gamma-conversion) of image data sent from a scanner and the like, I/O control such as outputting image data to a printer section and I/O of the operation and display section, and interfacing and operation control of the other application (facsimile, printer, and scanner).

ROM 102 stores various programs and data for the image forming apparatus 1 in advance. They are the system program, processing programs for the system, and data to be used by the processing programs.

RAM 103 temporarily stores a program, input or output data, and parameters that are read from ROM 102 and the memory section 104 in processing that is executed and controlled by the CPU 101.

The memory section 104 has the current value setting section 104*a*, the energization signal setting section 104*b*, and the switching signal setting section 104*c* to realize this embodiment.

The current value setting section 104*a* sets a signal Sp for setting current values to be applied to the first induction coil 11 and second induction coils 12*a* and 12*b* according to the operation mode such as image formation mode, warm-up mode, or standby mode of the image forming apparatus 1 and operating conditions such as voltage and frequency of the a.c. power supply of the image forming apparatus 1. The currents fed to the first induction coil 11, and second induction coils 12*a* and 12*b* are made identical by this signal Sp.

The energization signal setting section 104*b* sets the first and second energization signals S1, S2 from the first detection temperature T1, the second detection temperature T2, the upper limit fixing temperature TH and the lower limit fixing temperature TL of the heating roller 10.

The first energization signal S1 stops supplying a driving current to the first induction coil 11 when the first detection temperature T1 reaches the upper limit fixing temperature TH and starts supplying a driving current to the first induction coil 11 when the first detection temperature T1 reaches the lower limit fixing temperature TL.

The second energization signal S2 stops supplying a driving current to the second induction coils 12*a* and 12*b* when the second detection temperature T2 reaches the upper limit fixing temperature TH and starts supplying a driving current to the second induction coils 12*a* and 12*b* when the second detection temperature T2 reaches the lower limit fixing temperature TL.

The switching signal setting section 104*c* sets one cycle time and a duty cycle of the switching signal from a preset reference cycle time and a difference between first and second detection temperatures T1 and T2. The reference cycle is a cycle used as a reference to calculate the cycle of the switching signal Sc.

The memory section 104 can be part of the memory area in ROM 102.

The aforementioned operating mode "image formation" indicates that the user is forming an image on a recording material P by the image forming apparatus. "warm-up" indicates that the image forming apparatus is heating up the heating roller to a fixable temperature. "standby" indicates that the image forming apparatus stops its operation without any image formation for a preset time or longer. However, the operating modes can be any as long as it is related to the operations of the image forming apparatus 1.

Figure 4:
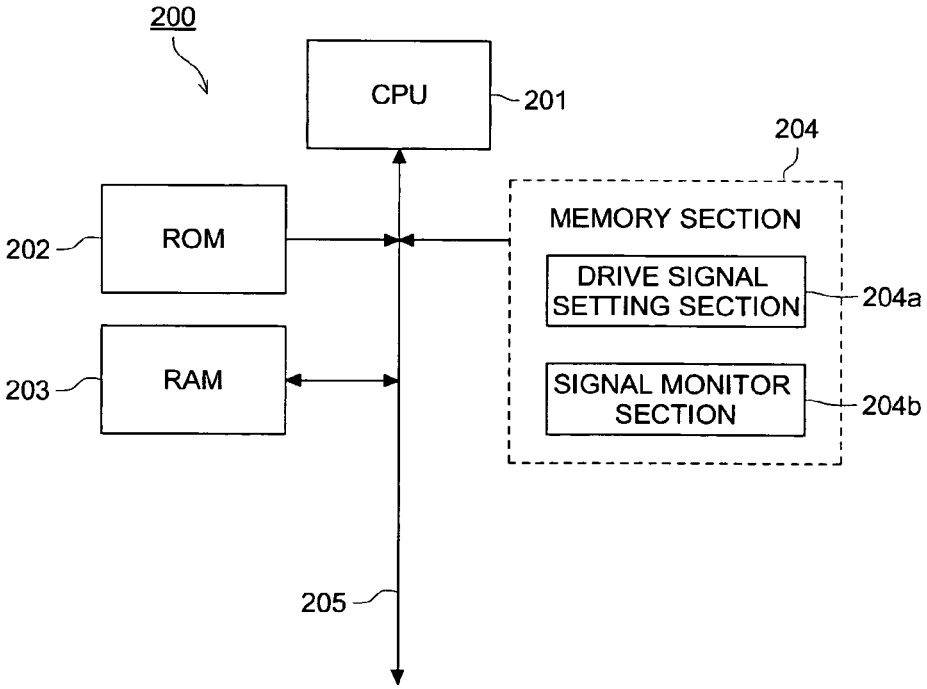
FIG. 4 is a functional block diagram of the IH control section 200.

FIG. 4 is a functional block diagram of the IH control section 200.

As shown in FIG. 4, the IH control section 200 is composed of the CPU 201, ROM 202, RAM 203, and the memory section 204. These components are interconnected with a bus 205 working as a transmitting means.

To realize this invention, the CPU 201 reads programs and data from respective sections such as the drive signal setting section 204*a* and the signal monitor section 204*b*, sets the first and second energization signals S11 and S12, monitors the first and second energization signals S1 and S2 and the switching signal Sc that come from the main body control section 100, and controls the first and second drive signals S11 and S12 by the result of monitoring.

Furthermore the CPU 201 reads a system program, processing programs, and data from the memory section 204, extract them on RAM 203, and controls operations of components in the fixing device 40 image forming apparatus 1 by the extracted programs.

ROM 202 stores various programs and data for the induction heating type of fixing device 40 in advance. They are the system program, processing programs for the system, and data to be used by the processing programs.

RAM 203 temporarily stores a program, input or output data, and parameters that are read from ROM 202 and the memory section 204 in processing that is executed and controlled by the CPU 201.

To realize this embodiment, the memory section 204 has the drive section setting section 204*a* and the signal monitor section 204*b*.

The drive signal setting section 204*a* monitors the first energization signal S1, the second energization signal S2, the switching signal Sc, and the current value setting signal Sp that come from the main body control section 100, and sets the first and second drive signals S11 and S12 by the above signals.

The signal monitor section 204*b* monitors the first energization signal S1, the second energization signal S2, and the switching signal Sc that come from the main body control section 100, and sets the first and second drive signals S11 and S12 to stop the first and second drive circuits 210 and 220 and to stop application of the driving currents to the first induction coil 11 and second induction coils 12*a* and 12*b* when at least one of the first and second energization signals S1 and S2 instructs to enable the drive current and when the switching signal Sc does not change for a preset time period or longer.

The memory section 204 can be part of the memory area in ROM 202.

Figure 5:
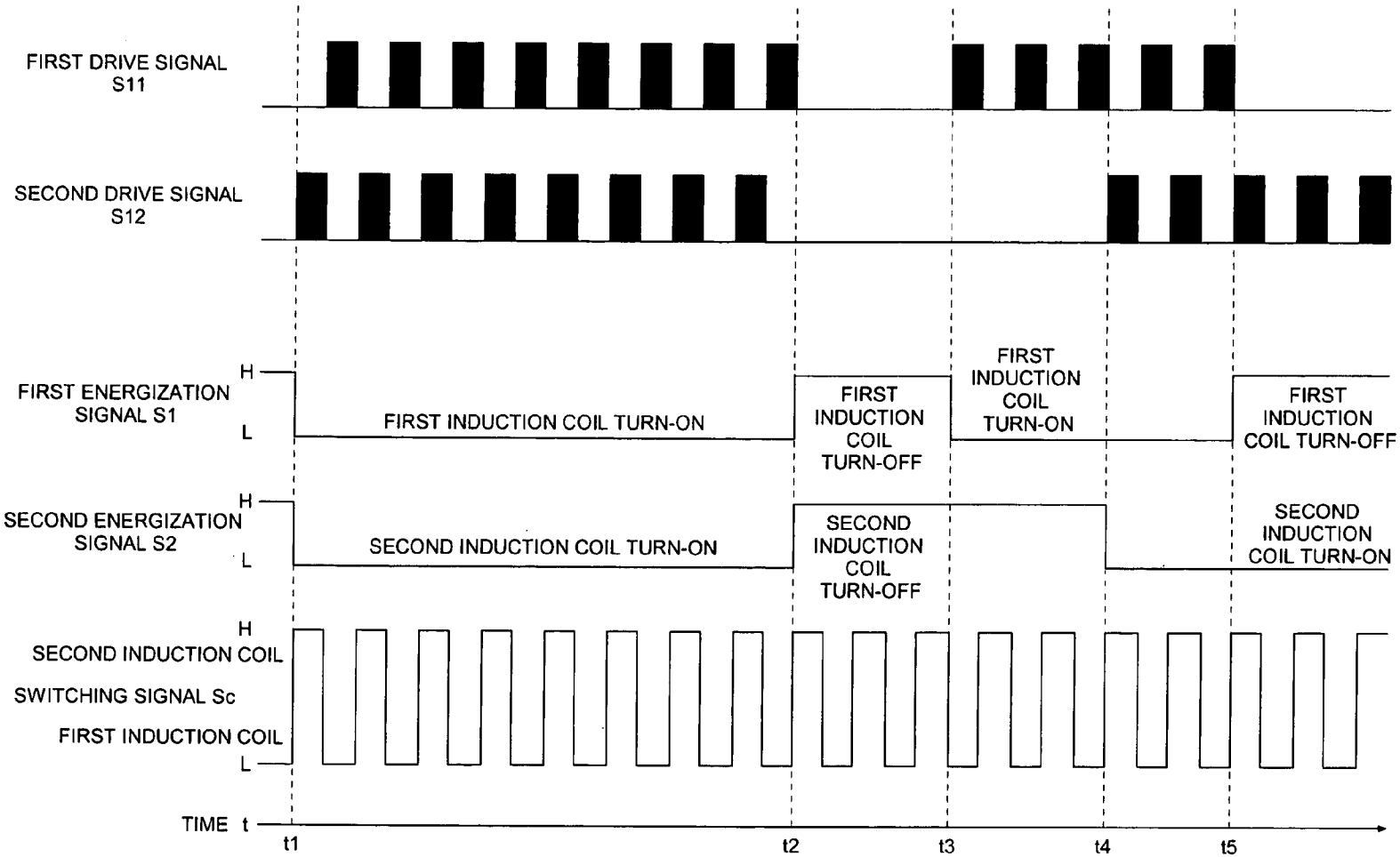
FIG. 5 is an example 1 of control timing chart of the embodiment of this invention.

FIG. 5 is an example 1 of control timing chart of the embodiment of this invention.

As shown in FIG. 5, when the switching signal Sc using a PWM signal is "H" energization of the second induction coils 12*a* and 12*b* is allowed but the energization of the first induction coil 11 is inhibited. When the switching signal Sc is "L" energization of the first induction coil 11 is allowed but the energization of the second induction coils 12*a* and 12*b* is inhibited. Switching to an energizable induction coil is cyclically instructed by "H" and "L" of the switching signal Sc.

The first energization signal S1 is not allowed (OFF) to supply power to the first induction coil 11 when the switching signal is "H" and is allowed (ON) to supply power to the first induction coil 11 when the switching signal is "L".

The second energization signal S2 is not allowed (OFF) to supply power to the second induction coils 12*a* and 12*b* when the switching signal is "H" and is allowed (ON) to supply power to the second induction coils 12*a* and 12*b* when the switching signal is "L".

The first drive signal S11 supplies a driving current to the first induction coil 11 when both the switching signal Sc and the first energization signal S1 are "L".

The second drive signal S12 supplies a driving current to the second induction coils 12*a* and 12*b* when the switching signal Sc is "H" and the second energization signal S2 is "L".

The solid black portions of the first and second drive signals S11 and S12 in FIG. 5 indicate quantities of the driving currents supplied to the first induction coil 11 and second induction coils 12*a* and 12*b*. The height of the leading edge of the signal is determined by the current value setting signal Sp.

In a time period between t1 and t2, as both the first and second energization signals S1 and S2 are "L" a driving current is alternately supplied to the first induction coil 11 and second induction coils 12*a* and 12*b* by the first and second drive signals S11 and S12 according to the switching signal Sc.

In a time period between t2 and t3, both the first and second energization signals S1 and S2 are "H" and a driving current is not supplied. Therefore, no driving current is supplied to the first induction coil 11 and second induction coils 12*a* and 12*b* by the first and second drive signals S11 and S12 independently of the switching signal Sc.

In a time period between t3 and t4, the first energization signal S1 is "L" and the second energization signal S2 is "H". Therefore, a driving current is supplied to only the first induction coil 11 intermittently at a preset interval according to the switching signal Sc. No driving current is supplied to the second induction coils 12*a* and 12*b*.

In a time period between t4 and t5 as well as the time period between t1 and t2, as both the first and second energization signals S1 and S2 are "L," a driving current is alternately supplied to the first induction coil 11 and second induction coils 12*a* and 12*b* by the first and second drive signals S11 and S12 according to the switching signal Sc.

In a time period after t5, the first energization signals S1 is "H" and the second energization signals S2 is "L". A driving current is supplied to only the second induction coils 12*a* and 12*b* intermittently at a preset interval according to the switching signal Sc.

In this way, the driving current is alternately supplied to the first induction coil 11 and second induction coils 12*a* and 12*b* by the first and second energization signals S1, S2 and the switching signal Sc. The driving current is never supplied to the first induction coil 11 and second induction coils 12*a* and 12*b* at the same time. It is possible to supply different quantities of driving currents to the first induction coil 11 and second induction coils 12*a* and 12*b* by making the first and second energization signals S1 and S2 different.

Figure 6:
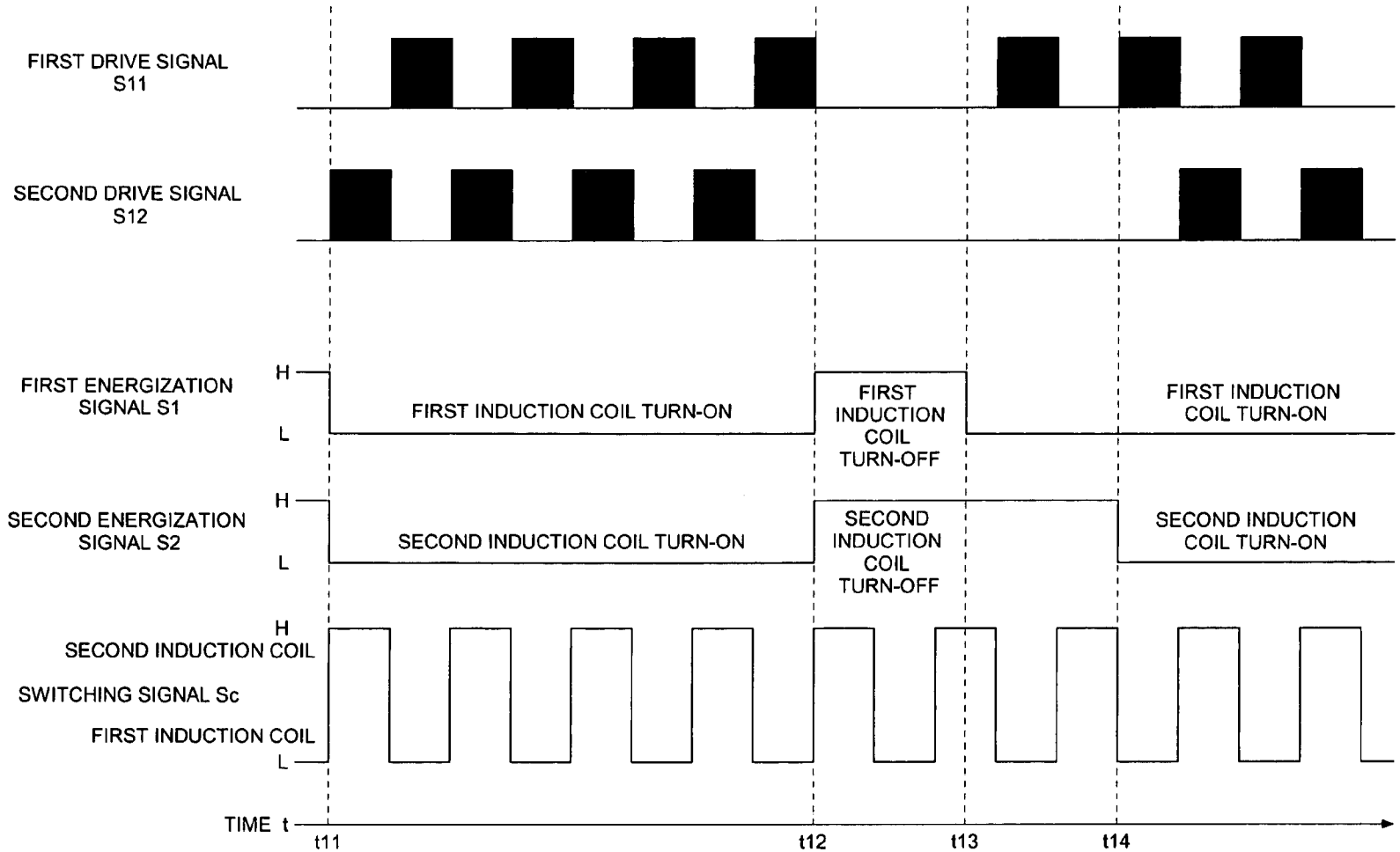
FIG. 6 is an example 2 of control timing chart of the embodiment of this invention.

FIG. 6 is an example 2 of control timing chart of the embodiment of this invention.

FIG. 6 indicates timing charts of the energization control for the first induction coil 11 and the second induction coil 12*a* and 12*b* when one cycle time of the switching circuit Sc in FIG. 5 is changed.

As the operation logics of the signals are similar to those of FIG. 5, the explanation is omitted here.

In a time period between t11 and t12, as both the first and second energization signals S1*a* and S2 are "L" a driving current is alternately supplied to the first induction coil and second induction coils 12*a* and 12*b* by the first and second drive signals S11 and S12 according to the switching signal Sc.

In a time period between t12 and t13, both the first and second energization signals S1 and S2 are "H" and a driving current is not supplied. Therefore, no driving current is supplied to the first induction coil 11 and second induction coils 12*a* and 12*b* by the first and second drive signals S11 and S12 independently of the switching signal Sc.

In a time period between t13 and t14, the first energization signal S1 is "L" and the second energization signal S2 is "H". Therefore, a driving current is supplied to only the first induction coil 11 intermittently at a preset interval according to the switching signal Sc. No driving current is supplied to the second induction coils 12*a* and 12*b*.

In a time period after t14 as well as the time period between t11 and t12, as both the first and second energization signals S1 and S2 are "L," a driving current is alternately supplied to the first induction coil 11 and second induction coils 12*a* and 12*b* by the first and second drive signals S11 and S12 according to the switching signal Sc.

As the one cycle time of the switching signal Sc can be changed as shown in FIG. 5 and FIG. 6, it is possible to minimize the influence by the reduction of the driving current which generates when the induction coil to be energized is changed by using the cycle time properly. Further, this can reduce a difference between the temperature in the center portion of the heating roller 10 and the temperature in the ends portions of the heating roller 10 and consequently offer steady fixing without wrinkles on the recording material P.

Figure 7:
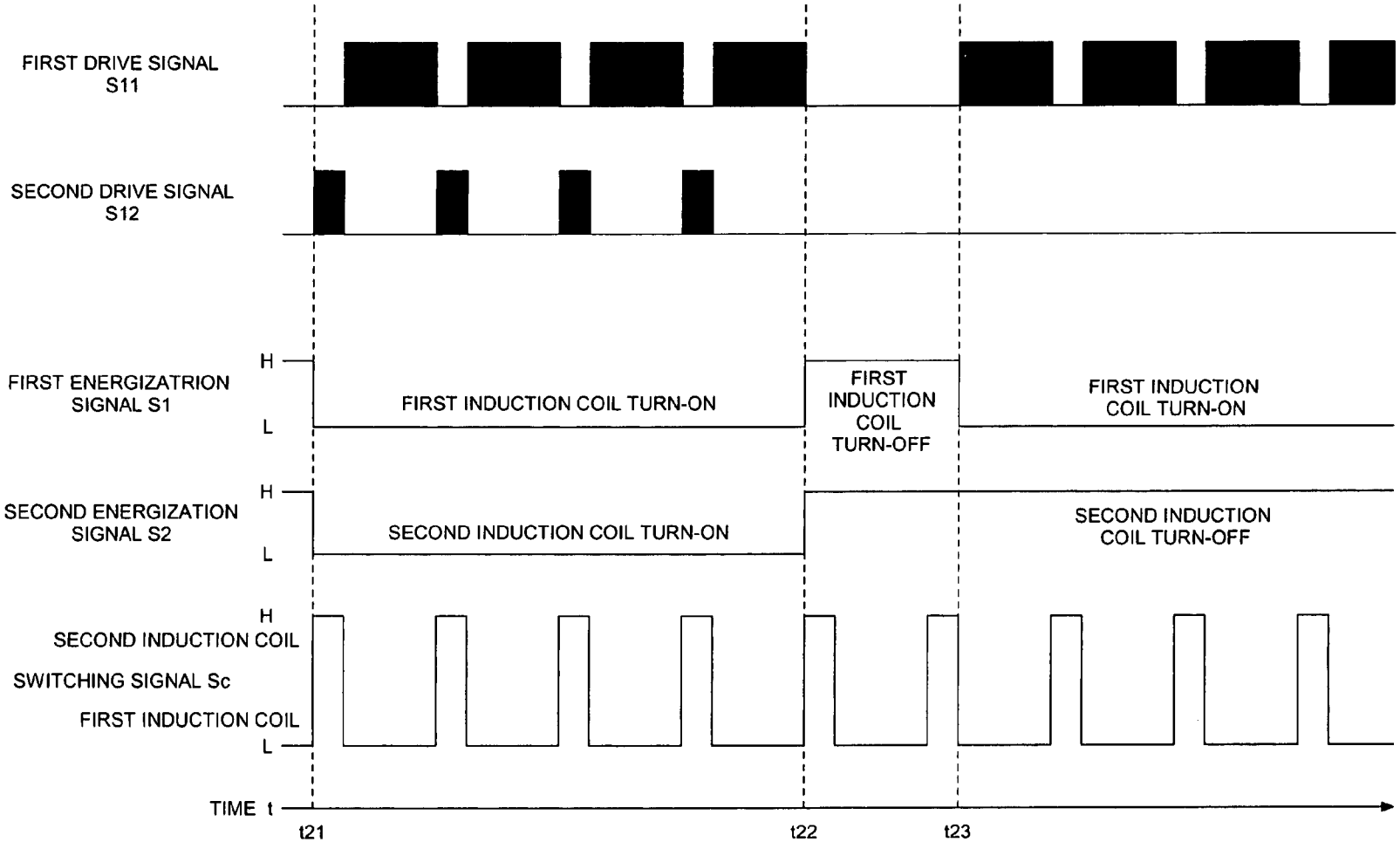
FIG. 7 is an example 3 of control timing chart of the embodiment of this invention.

FIG. 7 is an example 3 of control timing chart of the embodiment of this invention.

FIG. 7 shows a timing chart of energization control of the first induction coil 11 and second induction coils 12*a* and 12*b* in which the duty cycle of the switching signal Sc cycle of FIG. 5 is changed.

This timing chart assumes the duty cycle (that is, first induction coil 11 to second induction coil 12*a* and 12*b*) is 1:3. As the operation logics of the signals are similar to those of the above examples, the explanation is omitted here.

In a time period between t21 and t22, as both the first and second energization signals S1 and S2 are "L" a driving current is alternately supplied to the first induction coil 11 and second induction coils 12*a* and 12*b* by the first and second drive signals S11 and S12 according to the switching signal Sc.

In a time period between t22 and t23, both the first and second energization signals S1 and S2 are "H" and a driving current is not supplied. Therefore, no driving current is supplied to the first induction coil 11 and second induction coils 12*a* and 12*b* by the first and second drive signals S11 and S12 independently of the switching signal Sc.

In a time period after t23, the first energization signal S1 is "L" and the second energization signal S2 is "H". Therefore, a driving current is supplied to only the first induction coil 11 intermittently at a preset interval according to the switching signal Sc. No driving current is supplied to the second induction coils 12*a* and 12*b*.

It is possible to supply different quantities of driving currents to the first induction coil 11 and second induction coils 12*a* and 12*b*, to which an identical current is supplied, by changing the duty cycle of the switching signal Sc when both the first and second energization signals S1 and S2 allow the supply of the driving current (for example, in a time period between t21 and t22).

Figure 8:
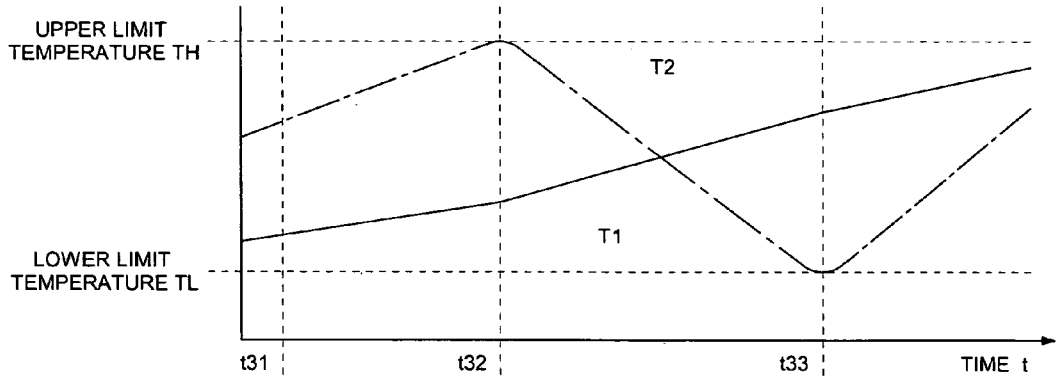
FIG. 8(*a*) and FIG. 8(*b*) respectively show a transition of temperature on the heating roller 10 when a smaller recording material P is fixed and an example 4 of control timing chart.
Figure 8:
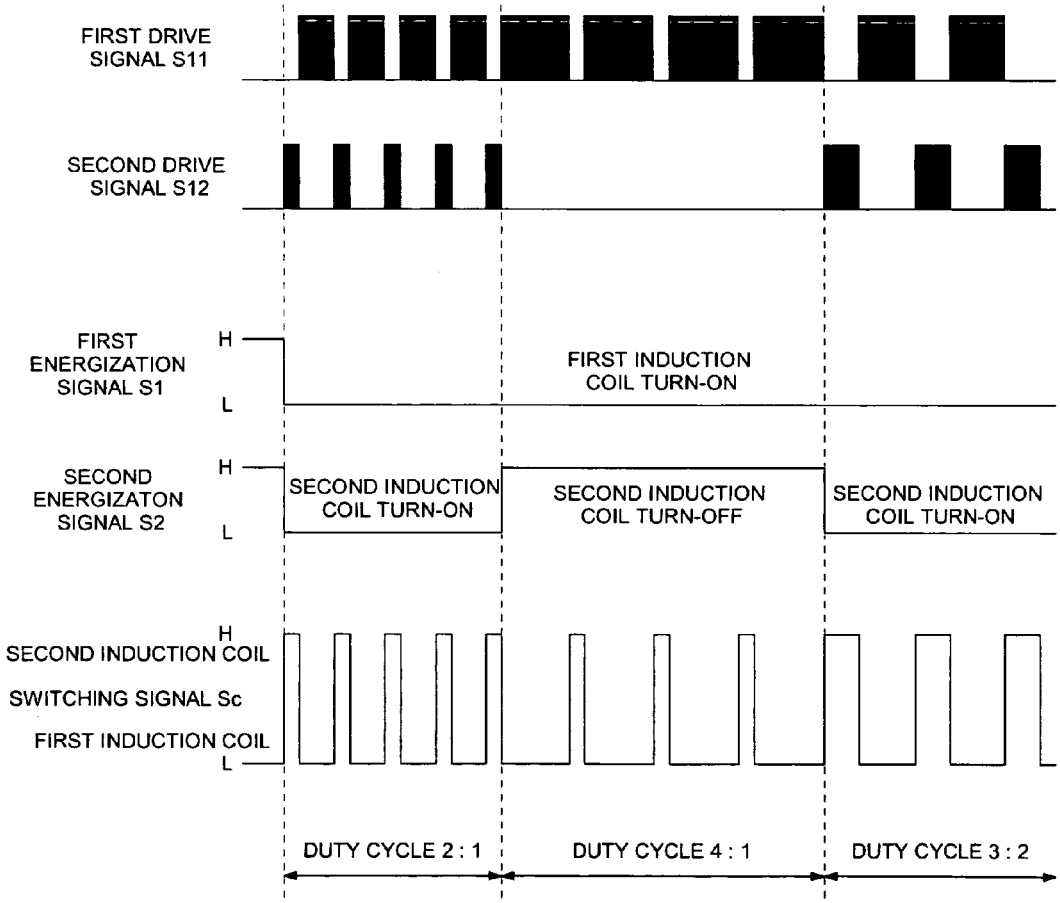

FIG. 8(*a*) and FIG. 8(*b*) respectively show a transition of temperature on the heating roller 10 when a smaller recording material P is fixed and an example 4 of control timing chart.

FIG. 8(*a*) shows transitions of the first detection temperature T1 detected by the first temperature sensor 51 and the second detection temperature T2 detected by the second temperature sensor 52 (namely, temperature transitions of the heating roller 10). FIG. 8(*b*) shows timing charts of the energization control.

In FIG. 8(*a*), the temperature range between TL (Lower limit temperature) and TH (Upper limit temperature) is fit for fixing by the heating roller 10. The solid line represents a transition of the first detection temperature T1 and the dash-dot line represents a transition of the second detection temperature T2.

When a small sized recording material is fixed, the heat in the central part of the heating roller 10 is absorbed by the recording material. Therefore, it is necessary to heat the central part of the heating roller 10 intensively. Contrarily, although the heat in the end parts of the heating roller 10 is not absorbed quickly because a small sized recording material does not pass over it, the heating roller 10 must have a uniform temperature distribution in preparation for the next recording material (e.g. a large sized recording material) after fixing the small sized recording material.

For that purpose, the cycle of the switching signal Sc is determined by the size and type of the recording material in use and the operation mode of the image forming apparatus 1. This can eliminate the uneven temperature distribution on the heating roller 10 caused by a recording material and an operation mode of the image forming apparatus 1.

In a time period between t31 and t32, neither the first energization signals S1 nor the second energization signals S2 reach the upper limit temperature TH. A small sized recording material is on the center portion of the heating roller 10 and fixed there. Therefore, the temperature rise rate of the center portion of the heating roller 10 is lower than that on the ends portions of the heating roller 10 and the first detection temperature T1 is lower than the second detection temperature T2.

Both the first and second energization signals S1 and S2 are set to "L" and the duty cycle of the switching signal Sc is set according to the difference between the first and second detection temperatures T1 and T2, for example, to 2:1 (namely, first induction coil 11 to second induction coil 12*a* and 12*b*). The switching signal Sc controls so that a driving current may be supplied alternately to the first induction coil 11 and second induction coils 12*a* and 12*b* by the first and second drive signals S11 and S12.

Consequently, a more driving current is supplied to the first induction coil 11 than to the second induction coils 12 and 12*b*. This increases the heat to the center portion of the heating roller 10 more than the heat to the ends portions of the heating roller 10. With this, the surface temperature of the whole heating roller 10 is kept uniform and constant.

At time t32, the small sized recording material is not on the ends portions of the heating roller 10 and consequently, the ends portions of the heating roller 10 becomes hotter than the center portion of the heating roller 10. The second detection temperature T2 reaches the upper limit temperature TH. With this, the second drive signal S2 becomes "H" and works to stop supplying a driving current to the second induction coils 12*a* and 12*b*.

In a time period between t32 and t33, only the center portions of the heating roller 10 is heated to increase the first detection temperature T1 which is still below the upper limit temperature TH.

The first energization signal S1 is set to "L" and the duty cycle of the switching signal Sc is set to supply a driving current intensively to the first induction coil 11, for example, to 4:1 (namely, first induction coil 11 to second induction coils 12*a* and 12*b*).

As the first energization signal S1 is "L" and the second energization signal S2 is "H". Consequently, power is supplied to the first induction coil 11 only according to the switching signal Sc and no driving current is supplied to the second induction coils 12*a* and 12*b*.

As a driving current is supplied to the first induction coil 11 only, the temperature rise rate of the first detection temperature T1 becomes greater. Contrarily, no power is supplied to the second induction coils 12*a* and 12*b*, the second detection temperature T2 gradually falls.

At time t33, the second detection temperature T2 reaches the lower limit temperature TL as no power is supplied to the second induction coils 12*a* and 12*b*. When the detection temperature T2 reaches the lower limit temperature TL, the second energization signal S2 becomes "L" and allows supplying a driving current to the second induction coils 12*a* and 12*b*.

In a time period after t33, both the first and second energization signals S1 and S2 are "L" and the duty cycle of the switching signal Sc is set to for example to 3:2 (that is, first induction coil 11 to second induction coil 12*a* and 12*b*) according to a difference between the first and second detection temperatures T1 and T2 to increase the second detection temperature T2 which is lower than the first detection temperature T1. The switching signal Sc controls to supply a driving current alternately to the first induction coil 11 and second induction coils 12*a* and 12*b* by the first and second drive signals S11 and S12.

Figure 9:
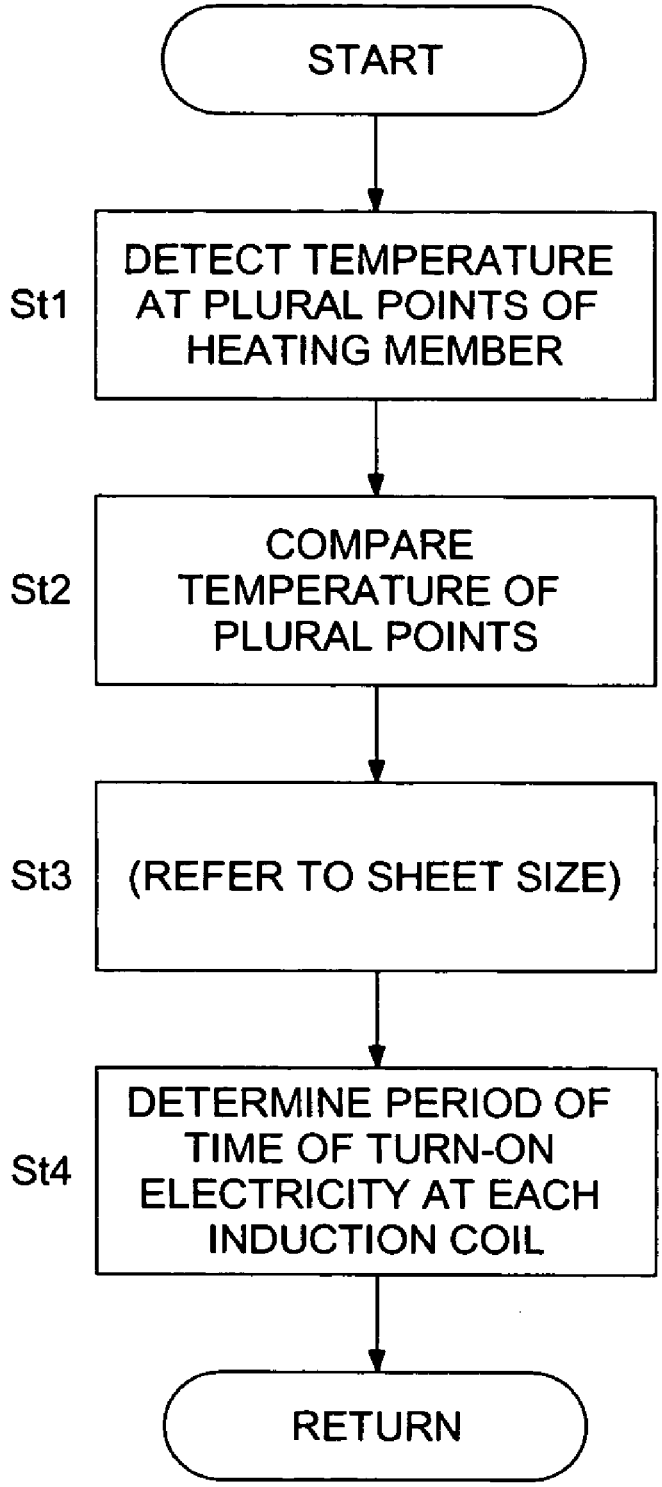
FIG. 9 is a flow chart of Example 5 in the embodiment of this invention.

Next, below will be explained another example 5 of energization control. As shown by a flow chart of FIG. 9, the temperatures of the central portion and ends portions of the heating roller 10 are detected by the first and second temperature sensors 51 and 52 which are temperature detecting means at step St1. At step St2, these detected temperatures are compared and their difference is calculated. At step St3, sheets of the same size are used (see Table 1). At step St4, a time period to energize each induction coil is determined to relatively increase the heat on the part of the heating roller 10 opposite the induction coil by comparing the energization time with optimum energization time data given in Table 1 that lists experimental optimum energization time obtained in advance for each detection area of ΔT1. As the result, the difference (ΔT1) between the detection temperatures of the temperature sensors 51 and 52 becomes smaller. The above steps are repeated and the temperature difference (ΔT1) becomes extremely smaller as the time goes by. In other words, the surface temperatures along the heating roller can be kept uniform.

This example 5 is effective when the control temperature of the heating roller 10 along its axis is constant. If the control temperature of the heating roller 10 along its axis is 2 levels or more, the control method of example 6 (to be explained below) is more effective.

TABLE 1

| ΔT1 (Center detection temperature − End detection temperature) | Time of energization (sec) Center of coil | End of coil |
|---|---|---|
| ΔT1 < −15° C. | 0.8 | 0.4 |
| −15° C. ≦ ΔT1 < −5° C. | 0.7 | 0.5 |
| −5° C. ≦ ΔT1 < +5° C. | 0.6 | 0.6 |
| +5° C. ≦ ΔT1 < +15° C. | 0.5 | 0.7 |
| +15° C. ≦ ΔT1 | 0.4 | 0.8 |

During printing (on A4-size paper)

Figure 10:
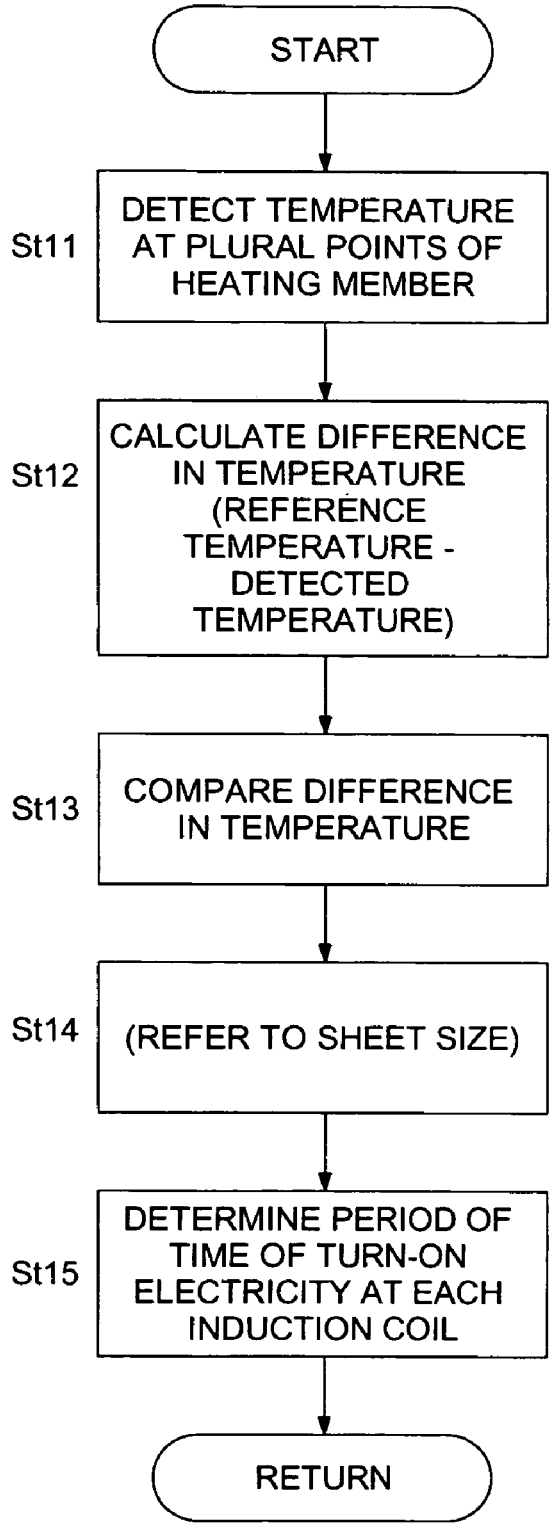
FIG. 10 is a flow chart of Example 6 in the embodiment of this invention.

The example 6 takes the steps below as shown by a flow chart of FIG. 10. At step St11 the temperature Ta at center portion and temperature Tb at ends portions of the heating roller 10 are detected by the temperature sensors 51 and 52 which are respectively provided in the center portion and ends portions of the heating roller 10. At step St12, a difference between the temperature detected by each sensor and the control temperature T0 on the part of the heating roller 10 opposite the sensor is calculated and then a difference between the differences is calculated as shown below: ΔT2=(Ta−T0)−(Tb−T0). At step St13, the above differences ΔT2 are compared. At step St14, sheets of the same size are used as shown in Table 2. At step St15, a time period to energize each induction coil is determined to relatively increase the heat on the part of the heating roller 10 opposite the induction coil by comparing the energization time with optimum energization time data given in Table 2 that lists experimental optimum energization time obtained in advance for each detection area of ΔT2 and increasing the energization time of an induction coil which is opposite the temperature sensor 51 or 52 whose difference of difference ΔT2 is relatively great so that the heat on the part of the heating roller 10 opposite the induction heating coil may be relatively increased. As the result, the difference of difference ΔT2 becomes smaller in fluctuation along the axis of the heating roller. The above steps are repeated and the temperature difference (ΔT1) of the sensors 51 and 52 becomes extremely smaller with passage of time. In other words, the surface temperatures along the heating roller 10 can be made uniform with the passage of time.

TABLE 2

| ΔT2 (Center (difference between the control temperature and the detected temperature) − Ends (difference between the control temperature and the detected temperature)) | Time of energization Center of coil | End of coil |
|---|---|---|
| ΔT2 < −15° C. | 0.8 | 0.4 |
| −15° C. ≦ ΔT2 < −5° C. | 0.7 | 0.5 |
| −5° C. ≦ ΔT2 < +5° C. | 0.6 | 0.6 |
| +5° C. ≦ ΔT2 < +15° C. | 0.5 | 0.7 |
| +15° C. ≦ ΔT2 | 0.4 | 0.8 |

In this embodiment, the switching signal Sc is selectively instructed to allow energization of the second induction coils 12*a* and 12*b* when Sc is "H" and to allow energization of the first induction coil 11 when Sc is "L". However, it is possible to allow energization of the first induction coil 11 when Sc is "H" and energization of the second induction coils 12*a* and 12*b* when Sc is "L". Further, in this embodiment, the first and second energization signals S1 and S2 do not allow supply of a driving current when the signal is "H" and allow supply of a driving current when the signal is "L". However, it is possible to allow supply of a driving current when the signal is "H" and to inhibit supply of a driving current when the signal is "L". Further more, any other control method can be used as long as the energization can be controlled by the switching signal Sc and the first and second energization signals S1 and S2 to inhibit simultaneous energization of the first induction coil 11 and second induction coils 12*a* and 12*b*.

With the use of a control means to perform energization control by periodically switching the driving current to each of the first induction coil 11 and the second induction coils 12*a* and 12*b* according to the first and second detection temperatures T1 and T2 sent from the first and second temperature sensors 51 and 52, and simultaneous energization of first induction coil 11 and second induction coils 12*a* and 12*b* can be prevented, thereby generation of vibrations and noises of the induction coils is suppressed, the fixing device can assure a maximum current for the fixing device in the limited driving current range available to the fixing device in the image forming apparatus 1, and obtain a uniform temperature distribution on the heating roller 10.

Further, energization of the first induction coil 11 and second induction coils 12*a* and 12*b* is controlled by the first and second energization signals S1 and S2 that instruct to allow supply of a driving current to each of the first induction coil 11 or second induction coils 12*a* and 12*b* and a switching signal Sc that selectively instructs to periodically switch allowance of energization of the first inductin coil 11 or second induction coils 12*a* and 12*b*. This can control energization of each of coils 11 and the coils 12*a* and 12*b* without simultaneous energization of coils 11, and the coils 12*a* and 12*b* and consequently realize a uniform temperature distribution on the heating roller 10 without vibrations and noises. Further this can offer a stable fixing ability without causing the recording material to get wrinkles even when the image forming apparatus changes the operation mode.

What is claimed is:

1. An induction heating type of fixing device to fix a recording material having a toner image thereon, the fixing device comprising:

(a) a heating member;

(b) an induction coil divided into a plurality of parts;

(c) a temperature detector for detecting a temperature of the heating member;

(d) a signal generator for generating a switching signal that periodically controls permission and prohibition of energization of each of the divided induction coils; and (e) a controller for controlling supply of a driving current to each of the divided induction coils to heat the heating member, wherein the controller controls the energization by periodically switching the driving current to each of the divided induction coils on the basis of an energization signal that determines the permission and the inhibition of the driving currents according to a signal of a temperature detected by the temperature detector, and the switching signal.

2. The induction heating type of fixing device of claim 1, wherein the switching signal is applied to adjoining first induction coil and second induction coils among the divided induction coils to inhibit energization of one of the induction coils when energization of the other induction coil is permitted or to permit energization of one of the induction coils when energization of the other induction coil is inhibited.

3. The induction heating type of fixing device of claim 2, further comprising a plurality of temperature detectors, wherein a one cycle time and a duty cycle of the switching signal are determined according to a difference of temperatures detected by the temperature detector.

4. The induction heating type of fixing device of claim 2, wherein the switching signal is determined by at least one of a size and a type of the recording material in use and an operation mode.

5. The induction heating type of fixing device of claim 2, the controller stops applying the driving current to all of the induction coils when the energization signal permits energization of the driving current and the switching signal does not change for a preset time period or longer.

6. The induction heating type of fixing device of claim 2, wherein the switching signal is a PWM signal.

7. An image forming apparatus comprising an image carrier for carrying a toner image, a transfer device for transferring the toner image from the image carrier onto a recording material, and an induction heating type of fixing device for thermally fixing the recording material having a toner image thereon, the induction heating type of fixing device comprising:

(a) a heating member;

(b) an induction coil divided into a plurality of parts;

(c) a temperature detector for detecting a temperature of the heating member;

(d) a signal generator for generating a switching signal that periodically controls permission and prohibition of energization of each of the divided induction coils; and (e) a controller for controlling supply of a driving current to each of the divided induction coils to heat the heating member, wherein the controller controls the energization by periodically switching the driving current to each of the divided induction coils on the basis of an energization signal that determines the permission and the inhibition of the driving currents according to a signal of a temperature detected by the temperature detector, and the switching signal.

8. The image forming apparatus of claim 7, wherein the switching signal is applied to adjoining first induction coil and second induction coils among the divided induction coils to inhibit energization of one of the induction coils when energization of the other induction coil is permitted or to permit energization of one of the induction coils when energization of the other induction coil is inhibited.

9. The image forming apparatus of claim 8, further comprising a plurality of temperature detectors, wherein a one cycle time and a duty cycle of the switching signal are determined according to a difference of temperatures detected by the temperature detector.

10. The image forming apparatus of claim 8, wherein the switching signal is at least one of a size and a type of the recording material in use and an operation mode.

11. The image forming apparatus of claim 8, wherein the controller stops applying the driving current to all of the induction coils when the energization signal permits energization of the driving current and the switching signal does not change for a preset time period or longer.

12. The image forming apparatus of claim 8, wherein the switching signal is a PWM signal.

* * * * *